United States Patent [19]

Victor et al.

[11] Patent Number: 5,019,144

[45] Date of Patent: May 28, 1991

[54] CRYOGENIC AIR SEPARATION SYSTEM WITH HYBRID ARGON COLUMN

[75] Inventors: Richard A. Victor; Michael J. Lockett, both of Grand Island; James R. Dray, Kenmore, all of N.Y.

[73] Assignee: Union Carbide Industrial Gases Technology Corporation, Danbury, Conn.

[21] Appl. No.: 540,313

[22] Filed: Jun. 19, 1990

Related U.S. Application Data

[63] Continuation of Ser. No. 468,875, Jan. 23, 1990, abandoned.

[51] Int. Cl.[5] ..... F25J 3/04

[52] U.S. Cl. ..... 62/22; 62/24

[58] Field of Search ..... 62/22, 24; 55/66

[56] References Cited

U.S. PATENT DOCUMENTS

| | | | |
|---|---|---|---|
| 2,047,444 | 7/1936 | Stedman | 261/94 |
| 4,186,159 | 1/1980 | Huber | 261/112 |
| 4,296,050 | 10/1981 | Meier | 261/112 |
| 4,813,988 | 3/1989 | Bennett et al. | 62/18 |
| 4,824,453 | 4/1989 | Rottman et al. | 62/22 |
| 4,836,836 | 6/1989 | Bennett et al. | 62/22 |
| 4,838,913 | 6/1989 | Victor et al. | 62/22 |
| 4,842,625 | 6/1989 | Allam et al. | 62/22 |
| 4,871,382 | 10/1989 | Thorogood et al. | 62/18 |

OTHER PUBLICATIONS

Aston, "Calculation of the Number of Plates in Air Rectification Tower", OSRD Report 3524 (1944).

Weedman et al, "Rectification of Liquid Air in a Packed Column", J. Ind. and Eng. Chem., 39 P732 (1947).

Chen, "Packed Column Internals", Chem. Eng., p. 40 (1984).

Alekseev, "Pack Columns for Air Rectification: Advantages of Regular Shaped Packing", IIR-Commisim A3, Brighton, England, p. 17.

Aston, "Liquid Air Fractionation", Ind. and Eng. Chem. 39, p. 718 (1947).

Zel'venskii, "Rectification of Argon in Columns with Regular Roll Packing", Kislorodnaya promysnlenost, 1978, 5, pp. 1-4.

Alekseev, "Operating Characteristics of Rectifying Columns with Regular Crimped Packing", Uses. Konf. Teor. Prakt. Reckt., p. 127.

Alekseev, "How Mesh Packings Can Be Used in the Rectification Towers of Air Separation Plants", Khim. Neft. Mash., 9, pp. 18-19 (1966).

Alekseev, "Film Fractionation of Air in Apparatus with a Regular Crimped Packing", Khim. Neft. Mash., 12, pp. 11-12 (1974).

Ellis et al, A High Efficiency, Low Pressure Drop Distillation Packing, Trans. Instn. Chem. Engrs, vol. 41, 1963, pp. 212-216.

*Primary Examiner*—Ronald C. Capossela

*Attorney, Agent, or Firm*—Stanley Ktorides

[57] ABSTRACT

A cryogenic rectification system characterized by a hybrid argon column having trays in the lower portion and packing in the upper portion whereby the argon column is operated at a lower pressure thus enabling improved argon recovery while maintaining the pressure sufficiently high at the lower end of the argon column to enable fluid flow back to the main column system without need for pressurization.

27 Claims, 2 Drawing Sheets

CRYOGENIC AIR SEPARATION SYSTEM WITH HYBRID ARGON COLUMN

This application is a continuation of prior U.S. application Ser. No. 468,875, filed 1/23/90 now abandoned.

TECHNICAL FIELD

This invention relates generally to cryogenic rectification wherein a feed comprising oxygen, nitrogen and argon is separated into oxygen-richer, nitrogen-richer, and argon-richer components.

BACKGROUND ART

An often used commercial system for the separation of a mixture comprising oxygen, nitrogen and argon, e.g. air, is cryogenic rectification. The separation is driven by elevated feed pressure which is generally attained by compressing feed in a compressor prior to introduction into a column system. The separation is carried out by passing liquid and vapor in countercurrent contact through the column or columns on vapor liquid contacting elements whereby more volatile component(s) are passed from the liquid to the vapor, and less volatile component(s) are passed from the vapor to the liquid. As the vapor progresses up a column it becomes progressively richer in the more volatile components and as the liquid progresses down a column it becomes progressively richer in the less volatile components. Generally the cryogenic separation is carried out in a main column system comprising at least one column wherein the feed is separated into nitrogen-rich and oxygen-rich components, and in an auxiliary argon column wherein feed from the main column system is separated into argon-richer and oxygen-richer components.

The power to operate the feed compressor and thus drive the separation is the major operating cost of the separation. Pressure drop within the system burdens the feed compression causing increased feed pressure requirements. It is desirable to operate the cryogenic rectification with as low a pressure drop as possible thus reducing feed compression requirements. Furthermore, the lower the pressure level within the columns the greater is the relative volatility between the components. The greater is the relative volatility between the components within a column, the easier is the separation, which in turn increases the recovery of argon, oxygen and nitrogen products.

In the operation of the argon column, a vapor stream having a relatively high argon concentration is taken from the main column system and passed into and up the argon column while becoming progressively richer in argon. A crude argon product is recovered from the top of the argon column. Vapor flows up the argon column due to a pressure gradient between the argon column feed and the crude argon product. The pressure of the argon column feed is determined by the main column conditions at the vapor takeoff point. Operation of the argon column at a lower pressure is subject to two constraints on how low the pressure can be irrespective of how the lower pressure is achieved. One constraint is that subatmospheric pressure at the top of the argon column should be avoided in order to avoid air leaks into the system. The other constraint involves the temperature difference for the top condenser of the argon column. A low pressure at the top of the argon column also results in a low temperature and thus the temperature difference between the condensing argon and the boiling kettle liquid in the argon condenser is reduced. A minimum temperature difference of about 0.7° K. is necessary for effective operation of the condenser. When the argon column pressure is reduced through the use of a valve, a particular disadvantage arises in that the liquid at the bottom of the argon column which must be returned to the main column is now at a lower pressure than the pressure in the main column at the return point. Thus repressurization of the liquid, for example by pumping or by raising the elevation of the argon column, is necessary. This repressurization is costly and creates a system inefficiency.

Accordingly it is an object of this invention to provide a cryogenic separation method for separating a feed comprising oxygen, nitrogen and argon wherein an argon column is operated at a lower average pressure without the need for repressurizing liquid passing from the argon column to the main column.

It is another object of this invention to provide a cryogenic separation apparatus comprising a main column system and an auxiliary argon column, which can operate at a lower average pressure without the need to increase the pressure of liquid passed from the argon column to the main column.

SUMMARY OF THE INVENTION

The above and other objects which will become apparent to one skilled in the art upon a reading of this disclosure are attained by the present invention, one aspect of which is:

Method for cryogenic rectification comprising:

(A) providing feed comprising oxygen, nitrogen and argon into a main column system comprising at least one rectification column;

(B) separating the feed by countercurrent vapor-liquid contact within the main column system into nitrogen-rich and oxygen-rich components;

(C) passing fluid comprising argon and oxygen from said main column system into an argon column;

(D) separating the fluid by countercurrent vapor-liquid contact within the argon column into argon-enriched and oxygen-enriched components; and (E) carrying out the countercurrent vapor-liquid contact in the argon column on vapor-liquid contacting elements comprising trays in the lower portion of the argon column, and on vapor-liquid contacting elements comprising packing in the remainder of the argon column.

Another aspect of this invention is:

Apparatus for cryogenic separation comprising:

(A) a main column system comprising at least one rectification column having vapor-liquid contacting elements;

(B) an argon column having vapor-liquid contacting elements comprising trays in the lower portion of the argon column and vapor-liquid contacting elements comprising packing in the remainder of the argon column; and (C) means to provide fluid from the main column system into said lower portion of the argon column.

The term, "column", as used herein means a distillation or fractionation column or zone, i.e., a contacting column or zone wherein liquid and vapor phases are countercurrently contacted to effect separation of a fluid mixture, as for example, by contacting of the vapor and liquid phases on a series of vertically spaced trays or plates mounted within the column or alternatively, on packing elements with which the column if filled. For a further discussion of distillation columns see the Chemical Engineers' Handbook, Fifth Edition, edited by R. H. Perry and C. H. Chilton, McGraw-Hill Book Company, New York, Section 13, "Distillation" B. D. Smith, et al., page 13-3 *The Continuous Distillation Process.* The term double column is used herein to mean a higher pressure column having its upper end in heat exchange relation with the lower end of a lower pressure column. A further discussion of double columns appears in Ruheman "The Separation of Gases" Oxford University Press, 1949, Chapter VII, Commercial Air Separation.

As used herein, the term "argon column" means a column wherein upflowing vapor becomes progressively enriched in argon by countercurrent flow against descending liquid and an argon product is withdrawn from the column.

The term "indirect heat exchange", as used herein means the bringing of two fluid streams into heat exchange relation without any physical contact or intermixing of the fluids with each other.

As used herein, the term "vapor-liquid contacting elements" means any devices used as column internals to facilitate mass transfer, or component separation, at the liquid vapor interface during countercurrent flow of the two phases.

As used herein, the term "tray" means a substantially flat plate with openings and liquid inlet and outlet so that liquid can flow across the plate as vapor rises through the openings to allow mass transfer between the two phases.

As used herein, the term "packing" means any solid or hollow body of predetermined configuration, size, and shape used as column internals to provide surface area for the liquid to allow mass transfer at the liquid-vapor interface during countercurrent flow of the two phases.

As used herein, the term "random packing" means packing wherein individual members do not have any particular orientation relative to each other or to the column axis.

As used herein, the term "structured packing" means packing wherein individual members have specific orientation relative to each other and to the column axis.

As used herein the term "theoretical stage" means the ideal contact between upwardly flowing vapor and downwardly flowing liquid into a stage so that the exiting flows are in equilibrium.

DETAILED DESCRIPTION

The process and apparatus of this invention will be described in detail with reference to FIG. 1.

Figure 1:
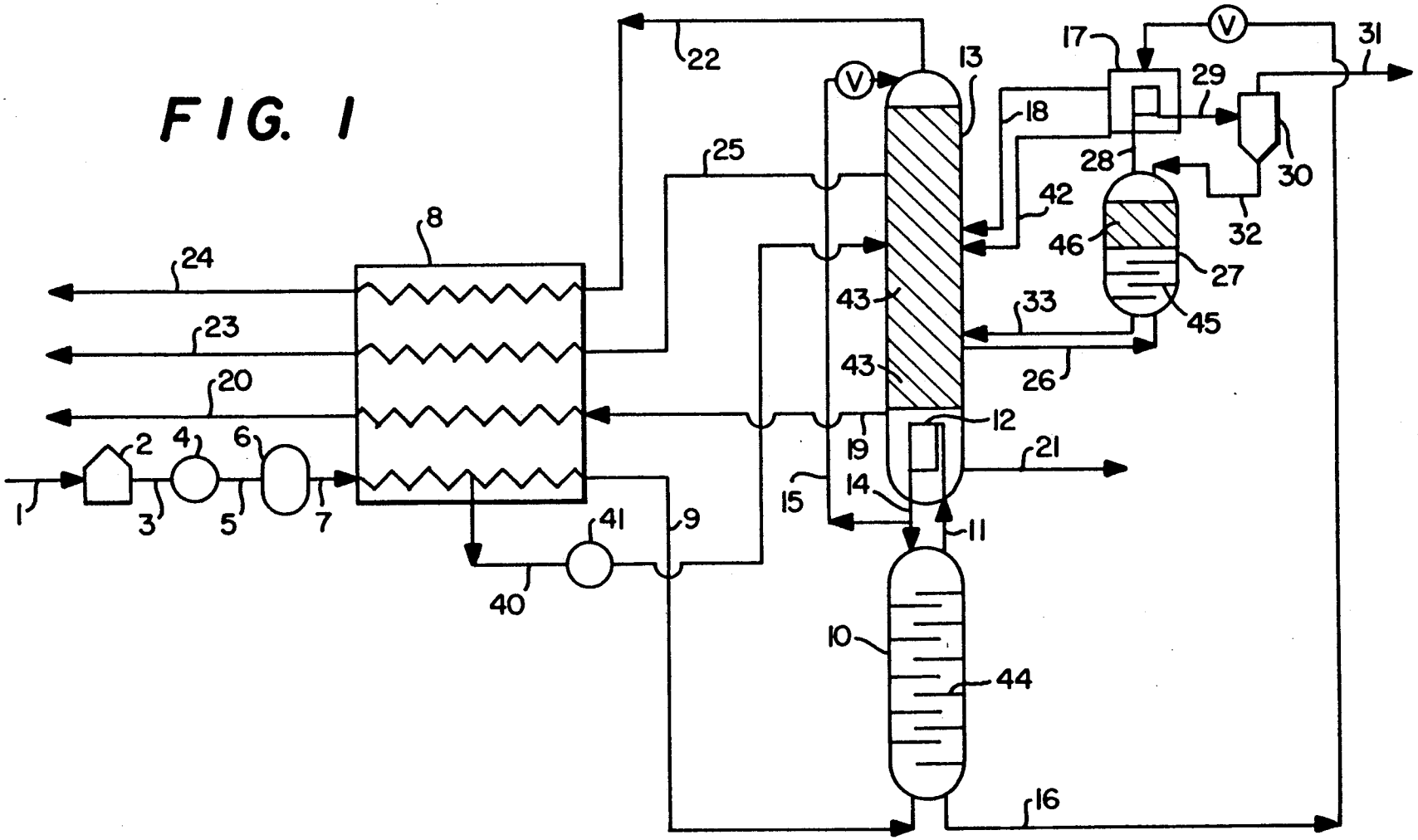
FIG. 1 is a simplified schematic flow diagram, partly in cross-section, of one preferred embodiment of the apparatus and process of this invention wherein the main column system comprises a double column.

Referring now to FIG. 1, feed 1, such as air, comprising oxygen, nitrogen and argon is cleaned of dust and other particulate matter by passage through filter 2. Filtered feed air 3 is compressed by passage through compressor 4 to a pressure generally within the range of from 70 to 190 psia. Compressed feed air 5 is then cleaned of high boiling impurities such as water, carbon dioxide and hydrocarbons, by passage through purifier 6. Cleaned, compressed feed air 7 is cooled to near liquefaction temperature by indirect heat exchange in heat exchanger 8 with product and waste streams from the columns. Cleaned, compressed and cooled feed air 9 is then introduced into first column 10 which is the higher pressure column of a double column main column system. Other main column systems which may be used with this invention include a single column, and two or more columns in series. Column 10 generally is operating at a pressure within the range of from 60 to 180 pounds per square inch absolute (psia). A minor fraction 40 of the feed air is withdrawn from the middle of heat exchanger 8, expanded in turbine 41 and introduced into lower pressure column 13 at a point below the nitrogen withdrawal points but above the argon column feed withdrawal point. These withdrawal points will be more fully described below. Column 13 is the lower pressure column of the double column main column system.

Within column 10 the feed air is separated by rectification into nitrogen-enriched vapor and oxygen-enriched liquid. Nitrogen-enriched vapor 11 is passed through conduit means from column 10 to main condenser 12, which is preferably within second column 13. Main condenser 12 may also be physically located outside the walls of column 13. Within main condenser 12 nitrogen-enriched vapor 11 is condensed by indirect heat exchange with reboiling column 13 bottom liquid. Resulting nitrogen-enriched liquid 14 is passed through conduit means to column 10 as reflux. A portion 15 of the resulting nitrogen-enriched liquid, generally within the range of from 20 to 50 percent, is passed into column 13 at or near the top of the column.

Oxygen-enriched liquid 16 is removed from first column 10 and passed into argon column top condenser 17 wherein it is partially vaporized by indirect heat exchange with argon column top vapor. Resulting vapor and liquid are passed into column 13 as streams 18 and 42 respectively at points below the nitrogen withdrawal points but above the argon column feed withdrawal point.

Second column 13 operates at a pressure less than that of first column 10 and generally within the range of from 12 to 45 psia. Within second column 13 the fluids introduced into the column are separated by rectification into nitrogen-rich and oxygen-rich components which may be recovered respectively as nitrogen and oxygen products. Oxygen product may be recovered as gas and/or liquid having a purity generally exceeding about 99 percent. Gaseous oxygen product is removed from second column 13 at a point above main condenser 12, passed as stream 19 through heat exchanger 8, and recovered as stream 20. Liquid oxygen product is removed from second column 13 at or below main condenser 12 and recovered as stream 21. Nitrogen product, having a purity generally exceeding about 99.9 percent, is removed from the top of second column 13 as stream 22, passed through heat exchanger 8 and recovered as stream 24. Waste nitrogen stream 25, which facilitates operation of the separation system, is also removed from second column 13, passed through heat exchanger 8 and vented as stream 23. Stream 25 is taken from second column 13 at a point below the point where nitrogen-enriched stream 15 is introduced into the column.

FIG. 1 illustrates one preferred arrangement wherein the vapor-liquid contacting elements within column 10 are all trays 44 and the vapor-liquid contacting elements within column 13 are all packing 43. The vapor-liquid contacting elements within column 10 may also be all packing or may comprise a combination of trays and packing. The vapor-liquid contacting elements within column 13 may also comprise all trays or may comprise a combination of trays and packing. One such combined arrangement for column 13 comprises trays in the portion of the column between the stream 40 introduction point and the stream 25 withdrawal point with the remainder of the vapor-liquid contacting elements being packing. The packing may be either random or structured packing. However, structured packing is preferred over random packing. Examples of structured packing include Stedman packing, described in U.S. Pat. No. 2,047,444, Goodloe packing, described in Ellis et al, Trans. Instn. Chem. Engrs., 41, 1963, and more recently developed, less costly but still efficient structured packing such as disclosed in Huber U.S. Pat. No. 4,186,159; and Meier U.S. Pat. No. 4,296,050.

The separation system of this invention further comprises the production of crude argon. Referring back to FIG. 1, a stream 26 is withdrawn from an intermediate point of column 13 where the argon concentration is at or close to a maximum within this column, generally about 10 to 20 percent. Stream 26 is generally and preferably a vapor stream as illustrated in FIG. 1. Most of the remainder of stream 26 comprises oxygen while nitrogen may be present in stream 26 in a concentration of less than one percent.

Stream 26 is passed from the main column system through conduit means into the lower portion of argon column 27 which is operating at a pressure generally within the range of from 12 to 45 psia. Vapor flows up column 27 and becomes progressively enriched in argon by countercurrent flow against descending liquid.

Argon-enriched vapor 28 is passed from argon column 27 to top condenser 17 wherein it is partially condensed by indirect heat exchange with partially vaporizing oxygen-enriched liquid 16. Resulting partially condensed argon-enriched fluid 29 is passed to separator 30. Argon-enriched vapor 31 is recovered from separator 30 as crude argon product having an argon concentration generally exceeding 96 percent while liquid 32 is passed from separator 30 into argon column 27 as the descending liquid. Liquid accumulating at the bottom of argon column 27, having an oxygen concentration exceeding that of stream 26, is passed as stream 33 into second column 13. The flow of vapor through argon column 27 is effected by a pressure difference between the pressure of stream 26 and the pressure of stream 28.

The vapor-liquid contacting elements within argon column 27 comprise at least one tray in the lower portion of the argon column. In the broadest embodiment of this invention the lower portion of the argon column comprises the lower 50 percent of the height of the argon column wherein during operation the argon concentration in the contacting vapor and liquid is generally about 75 percent or less. In a preferred embodiment of the invention, the lower portion of the argon column comprises the lower 25 percent of the height of the argon column wherein during operation the argon concentration in the contacting vapor and liquid is generally about 50 percent or less. In a more preferred embodiment of the invention the lower portion of the argon column comprises the lower 10 percent of the height of the argon column wherein during operation the argon concentration in the contacting vapor and liquid is generally about 25 percent or less. As illustrated in FIG. 1, the vapor-liquid contacting elements are all trays in this lower portion of the argon column. The vapor-liquid contacting elements in the remainder of the argon column where the argon concentration generally exceeds the above-recited concentration comprise packing 46. Preferably the packing is structured packing.

The number of trays in the lower portion of the argon column can range from a minimum of about 1 to 5 trays to a maximum of about 20 to 30 trays. The number of trays depends on the tray pressure drop per theoretical stage, the packing pressure drop per theoretical stage, the number of theoretical stages specified between the top of the upper column and the point from which vapor is taken to feed the argon column, and also on the number of theoretical stages specified in the argon column. The number of trays used must not be so large that the pressure at the top of the argon column falls below atmospheric since there is then a risk of argon product contamination from leaks. Nor should the number of trays be so large that the pressure and hence temperature of the condensing argon vapor at the top of the argon column be too low for effective heat transfer performance of the argon condenser. Typically up to about half the theoretical stages in the argon column can comprise trays before these problems occur. A sufficient number of trays are used in the lower portion of the argon column to enable the operation of the argon column at a lower average pressure than that of the column operating with all packing while maintaining the pressure at the bottom of the argon column at about the same pressure as that of the main column at the point fluid is taken from the main column for passage into the argon column.

It is an important aspect of this invention that the fluid passed from the main column system into the argon column be passed into the lower portion of the argon column where the vapor-liquid contacting elements comprise trays and preferably, as illustrated in FIG. 1, the argon column feed stream is introduced into the argon column at the bottom of the column. In this way the upward flowing vapor within the argon column undergoes a pressure drop while passing through the trayed section thus establishing a significant pressure gradient at the bottom of the column. The use of packing in the upper section of the argon column reduces the pressure gradient over the remainder of the column. With the use of trays in the lower section of the argon column, the pressure at the bottom of the argon column is not different from that of the incoming stream from the main column system, other than for minor pressure drop in the conduit, and thus liquid from the argon column, such as stream 33 illustrated in FIG. 1, may be returned to the main column system without need for pressurization, such as by pumping or liquid head.

The combined use of trays and packing in the argon column allows the operation of the argon column at lower average pressure levels compared to that attainable with all packing in the argon column. Thus the benefit from the improved relative volatility of argon with respect to oxygen at lower pressure enables improved argon separation and recovery without introducing any operational problems at the top or the bottom of the argon column.

Any suitable type of trays may be used with this invention. Among such types one can name sieve trays, bubble cap trays and valve trays. Trays which produce a higher pressure drop per tray are preferred as in this way the advantages of this invention are attained with fewer trays within the argon column. For example, suitable trays may include sieve trays with low perforation areas.

Figure 2:
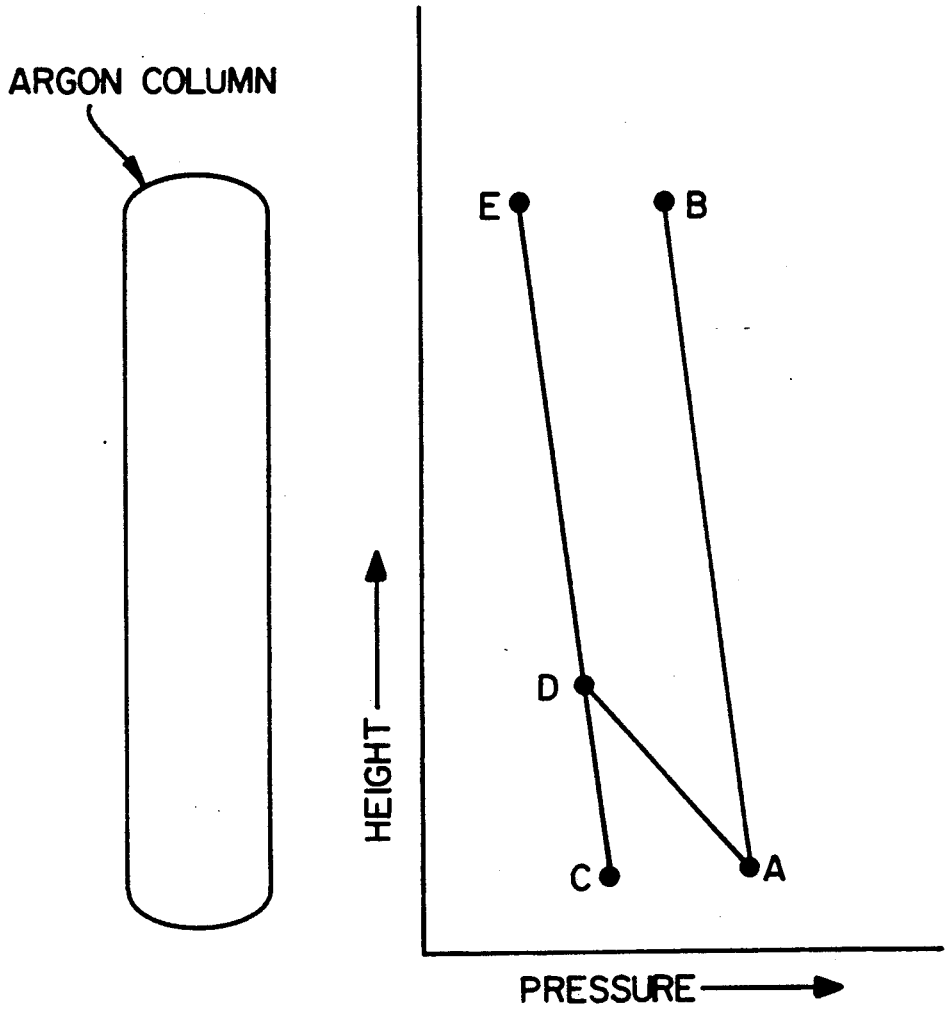
FIG. 2 is a graphical representation of generalized argon column pressure profiles with argon column height.

FIG. 2 illustrates the pressure profiles of a conventional argon column, an argon column with feed pressure reduction such as by a valve, and the hybrid argon column of this invention. Referring now to FIG. 2, line A-B illustrates the pressure profile of a conventional all packing argon column over the height of the argon column. Line C-D-E illustrates the pressure profile of a conventional all packing argon column wherein the feed is reduced in pressure prior to introduction into the column. Line A-D-E illustrates the pressure profile of the hybrid argon column of this invention over the height of the argon column. As can be seen, the pressure at the top of the hybrid argon column is the same as that of the reduced feed pressure column. However, the pressure at the bottom of the hybrid argon column exceeds that of the reduced feed pressure column. Accordingly most of the lower pressure advantages are achieved with the hybrid argon column while also enabling fluid return from the argon column to the main column system without need for pressurization of this return stream.

Now by use of the method and apparatus of the present invention one can carry out cryogenic air separation with improved argon recovery. In a double column system, the lower pressure column vapor-liquid contacting elements may consist essentially of packing thus reducing the pressure drop over this column and reducing feed compression requirements. Furthermore packing is employed in the argon column to enhance argon recovery. However, with the lower portion of the argon column having vapor-liquid contacting elements comprising trays, the requisite pressure gradient is provided within the argon column to enable suitable vapor upflow without causing subatmospheric conditions at the top of the argon column, and while maintaining sufficient pressure at the bottom of the argon column to return liquid from the argon column back to the main column system without need for further pressurization.

In the method and apparatus of this invention, the trays within the lower portion of the argon column simultaneously perform two functions. They serve as means to create a pressure reduction at the inlet of the argon column so that the argon column can operate at lower average pressure levels. Simultaneously they serve as vapor-liquid contacting elements to effect mass transfer between the upflowing vapor and the descending liquid within the argon column.

While the invention has been described in detail with reference to certain embodiments, it will be recognized by those skilled in the art that there are other embodiments of the invention within the spirit and scope of the claims.

We claim:

1. Method for cryogenic rectification comprising:

(A) providing feed comprising oxygen, nitrogen and argon into a main column system comprising at least one rectification column;

(B) separating the feed by countercurrent vapor-liquid contact within the main column system into nitrogen-rich and oxygen-rich components;

(C) passing fluid comprising argon and oxygen from said main column system into an argon column having an upper portion and a lower portion;

(D) separating the fluid by countercurrent vapor-liquid contact within the argon column into argon-enriched and oxygen-enriched components; and (E) carrying out the countercurrent vapor-liquid contact in the argon column on vapor-liquid contacting elements comprising trays in the lower portion of the argon column, and on vapor-liquid contacting elements comprising packing in the upper portion of the argon column.

2. The method of claim 1 wherein the lower portion of the argon column comprises that portion wherein the argon concentration of the contacting vapor and liquid is 75 percent or less.

3. The method of claim 1 wherein the lower portion of the argon column comprises that portion wherein the argon concentration of the contacting vapor and liquid is 50 percent or less.

4. The method of claim 1 wherein the lower portion of the argon column comprises that portion wherein the argon concentration of the contacting vapor and liquid is 25 percent or less.

5. The method of claim 1 wherein the vapor-liquid contacting elements in the lower portion of the argon column are all trays.

6. The method of claim 1 wherein the vapor-liquid contacting elements in the upper portion of the argon column are all packing.

7. The method of claim 1 wherein the packing comprises structured packing.

8. The method of claim 1 wherein oxygen-richer component is passed from the argon column to the main column system.

9. The method of claim 1 wherein argon-enriched component is recovered having an argon concentration of at least 96 percent.

10. The method of claim 1 wherein the main column system is a double column having a lower pressure column in heat exchange relation with a higher pressure column.

11. The method of claim 10 wherein the lower pressure column has vapor-liquid contacting elements which are all packing.

12. The method of claim 11 wherein the packing in the lower pressure column comprises structured packing.

13. The method of claim 10 wherein the higher pressure column has vapor-liquid contacting elements which are all trays.

14. The method of claim 1 further comprising recovering nitrogen-rich component as product nitrogen.

15. The method of claim 1 further comprising recovering oxygen-rich component as product oxygen.

16. Apparatus for cryogenic rectification comprising:

(A) a main column system comprising at least one rectification column having vapor-liquid contacting elements;

(B) an argon column having an upper and lower portion and having vapor-liquid contacting elements comprising trays in the lower portion of the argon column, and vapor-liquid, contacting elements comprising packing in the upper portion of the argon column; and (C) means to provide fluid from the column system into said lower portion of the argon column.

17. The apparatus of claim 16 wherein the lower portion of the argon column comprises the lower 50 percent of the height of the argon column.

18. The apparatus of claim 16 wherein the lower portion of the argon column comprises the lower 25 percent of the height of the argon column.

19. The apparatus of claim 16 wherein the lower portion of the argon column comprises the lower 10 percent of the height of the argon column.

20. The apparatus of claim 16 wherein the vapor-liquid contacting elements within the lower portion of the argon column are all trays.

21. The apparatus of claim 16 wherein the vapor-liquid contacting elements within the upper portion of the argon column are all packing.

22. The apparatus of claim 16 wherein the packing comprises structured packing.

23. The apparatus of claim 16 further comprising means to provide fluid from the argon column to the main column system.

24. The apparatus of claim 16 wherein the main column system is a double column having a lower pressure column in heat exchange relation with a higher pressure column.

25. The apparatus of claim 24 wherein the lower pressure column has vapor-liquid contacting elements which are all packing.

26. The apparatus of claim 25 wherein the packing within the lower pressure column comprises structured packing.

27. The apparatus of claim 24 wherein the higher pressure column has vapor-liquid contacting elements which are all trays.

* * * * *